United States Patent [19]

Urabe et al.

[11] 4,431,730

[45] Feb. 14, 1984

[54] PROCESS FOR THE PREPARATION OF INTERNAL LATENT IMAGE TYPE SILVER HALIDE PHOTOGRAPHIC EMULSIONS

[75] Inventors: Shigeharu Urabe; Shinji Sakaguchi; Ichizo Toya; Tadao Sugimoto, all of Minami-ashigara, Japan

[73] Assignee: Fuji Photo Film Co., Ltd., Kanagawa, Japan

[21] Appl. No.: 349,445

[22] Filed: Feb. 17, 1982

[30] Foreign Application Priority Data

Feb. 18, 1981 [JP] Japan ..... 56-22681

[51] Int. Cl.[3] ..... G03C 1/28

[52] U.S. Cl. ..... 430/604; 430/604/166; 430/599; 430/940; 430/600; 430/569; 430/564; 430/409; 430/627; 430/630; 430/603; 430/605

[58] Field of Search ..... 430/599, 600, 940, 569, 430/627, 630, 596, 598, 411, 409, 410, 604, 564, 603, 605

[56] References Cited

U.S. PATENT DOCUMENTS

| | | | |
|---|---|---|---|
| 3,006,762 | 10/1961 | Dersch | 430/600 |
| 3,850,637 | 11/1974 | Evans | 430/409 |
| 4,294,920 | 10/1981 | Helling et al. | 430/609 |

FOREIGN PATENT DOCUMENTS

| | | | |
|---|---|---|---|
| 586916 | 11/1959 | Canada | 430/600 |
| 632762 | 12/1961 | Canada | 430/609 |
| 1585791 | 1/1970 | France | 430/411 |

*Primary Examiner*—Won H. Louie, Jr.

*Attorney, Agent, or Firm*—Sughrue, Mion, Zinn, Macpeak & Seas

[57] ABSTRACT

A process for the preparation of an internal latent image type silver halide emulsion containing silver halide grains comprising a central core of silver halide doped with metal ions, chemically sensitized or a combination thereof and an outer shell of silver halide covering at least light-sensitive sites of the central core characterized in that the surface of the silver halide grains are chemically sensitized in the presence of a polymer containing the repeating unit represented by general formula (I)

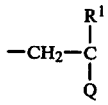

wherein symbols $R^1$ and Q are defined in the specification.

11 Claims, No Drawings

PROCESS FOR THE PREPARATION OF INTERNAL LATENT IMAGE TYPE SILVER HALIDE PHOTOGRAPHIC EMULSIONS

FIELD OF THE INVENTION

The present invention relates to a process for the preparation of internal latent image type silver halide photographic emulsions, more particularly, to a process for the preparation of internal latent image type silver halide photographic emulsions showing excellent reversal characteristics.

BACKGROUND OF THE INVENTION

It is known, as described in U.S. Pat. Nos. 3,317,322, 3,761,276, etc., that chemical sensitization of the surface of internal latent image type silver halide grains comprising a central core of silver halide subjected to metal ion doping, chemical sensitization or a combination thereof and a chemically sensitized outer shell of silver halide covering at least light-sensitive sites of the central core (hereinafter these grains are referred to as "core/shell type grains") permits one to obtain a reversal image by direct reversal processing of the type where development is performed in the presence of a fogging agent or the elements is over-all light-exposed at development.

However, chemically sensitized nuclei prepared by the chemical sensitization of the surface of such core/shell type silver halide grains are poor with respect to stability with time and, therefore, when used after storage for a long period of time, give rise to the problems that there cannot be obtained a reversal image having a desired maximum density ($D_{max}$), and the minimum density ($D_{min}$) of the reversal image is increased.

Chemical sensitization of the surface of internal latent image type silver halide grains inevitably causes an increase in the formation of negative images. With conventional surface chemical sensitization methods, when surface chemical sensitization is performed to the extent that the $D_{max}$ of the reversal image obtained is satisfactory, the increase in the formation of the negative images is large, resulting in deterioration of reversal photographic characteristics, e.g., formation of false images at high illumination areas. Moreover, the $D_{max}$ values obtained by conventional surface chemical sensitization methods are not sufficiently large as compared with the $D_{min}$ values. As a result, the discrimination of the reversal image is insufficient and, at the same time, it is difficult to obtain a reversal image of high tone.

Furthermore, direct positive silver halide light-sensitive materials prepared using conventional internal latent image type silver halide photographic emulsions have poor low illumination reciprocity law failure characteristics, and it has been desired to improve such poor low illumination reciprocity law failure characteristics.

SUMMARY OF THE INVENTION

One object of the invention is to provide a process for the preparation of an internal latent image type silver halide photographic emulsion capable of providing a reversal image having a high maximum density ($D_{max}$) without deteriorating other reversal photographic characteristics.

Another object of the invention is to provide a novel process for the surface chemical sensitization of core/shell type silver halide grains suitable for use in an internal latent image type silver halide photographic emulsion.

Still another object of the invention is to provide a process for the surface chemical sensitization of core/shell type silver halide grains which will not increase the formation of negative images.

Still another object of the invention is to provide a process for the surface chemical sensitization of core/shell type silver halide grains which produces a chemically sensitized core having high stability with time.

Still another object of the invention is to provide a process for the preparation of an internal latent image type silver halide photographic emulsion capable of providing a reversal image having excellent discrimination and high gradation.

Still another object of the invention is to provide a process for the preparation of an internal latent image silver halide photographic emulsion having improved low illumination reciprocity law failure characteristics.

It has been found that the above objects are attained by chemically sensitizing the surface of silver halide grains in the presence of a polymer having the repeating unit represented by general formula (I):

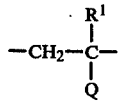

wherein $R^1$ is a hydrogen atom or an alkyl group ($C_{1-10}$, preferably $C_{1-3}$), and Q is any one of the groups (1) to (4) set forth below:

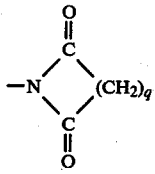

(1)

(wherein q is an integer of from 2 to 4),

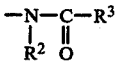

(2)

(wherein $R^2$ and $R^3$ are each a hydrogen atom or an alkyl group ($C_{1-10}$, preferably $C_{1-3}$)),

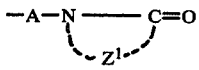

(3)

(wherein $Z^1$ is a group of atoms required for forming a lactam ring, an oxazolidone ring or a pyridone ring, and A is merely a bond, or

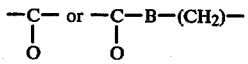

(wherein B is

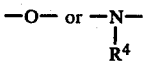

(wherein $R^4$ is a hydrogen atom or an alkyl group ($C_{1-3}$)), and is an integer of from 1 to 6),

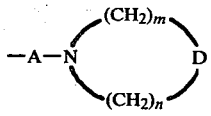

(4)

(wherein A is the same as defined for formula (3), D is merely a bond, or

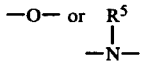

(wherein $R^5$ is a hydrogen atom, an alkyl group ($C_{1-3}$) or

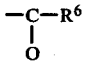

(wherein $R^6$ is an alkyl group ($C_{1-3}$), and m and n are each an integer of from 1 to 6, and m+n is from 4 to 7).

The present invention, therefore, relates to a process for the preparation of an internal latent image type silver halide photographic emulsion containing silver halide grains comprising a central core of silver halide subjected to metal ion doping, chemical sensitization or a combination thereof and an outer shell of silver halide covering at least light-sensitive sites of the central core, which is characterized in that the surface of the silver halide grain is subjected to chemical sensitization in the presence of a polymer having the repeating unit represented by general formula (I) as defined above.

DETAILED DESCRIPTION OF THE INVENTION

The term "internal latent image type silver halide emulsion" is used herein to refer to a emulsion which, when coated on a support, exposed to light for a fixed time of from 0.01 to 1 second, and developed with Developer A (an internal type developer) as set forth hereinafter at 20° C. for 3 minutes, provides an image whose maximum density as determined by a conventional photographic density measuring method is at least five times that of an image which is obtained when the same emulsion as above is coated and exposed to light in the same manner as above, but is developed with Developer B (a surface type developer) as set forth hereinafter at 20° C. for 4 minutes.

| | Amount (g) |
|---|---|
| Developer A | |
| Hydroquinone | 15 |
| Monomethyl-p-aminophenolsesquisulfate | 15 |
| Sodium sulfite | 50 |
| Potassium bromide | 10 |
| Sodium hydroxide | 25 |
| Sodium thiosulfate | 20 |
| Water to make | 1 liter |
| Developer B | |
| p-Oxyphenylglycine | 10 |
| Sodium carbonate | 100 |
| Water to make | 1 liter |

In accordance with the process of the invention, a central core of silver halide which is subjected to metal ion doping, chemical sensitization or a combination thereof is first prepared and, thereafter, the surface of the central core of silver halide is covered with an outer shell of silver halide. It is not necessary to cover the whole of the surface of silver halide grain in the central core with the outer shell, rather, it is sufficient to cover only light-sensitive sites (where light-decomposed silver is formed by application of light exposure) of the central core.

For metal ion doping of the central core, there can be employed a method, for example, in which the formation of silver halide grains in the central core or physical ripening thereof is performed in the presence of a metal ion source, e.g., cadmium salts, zinc salts, lead salts, thallium salts, iridium salts or complex salts thereof, rhodium salts or complex salts thereof, and iron salts or complex salts thereof. The amount of metal ions used is usually at least $10^{-6}$ mol per mol of silver halide.

The silver halide constituting the central core may be chemically sensitized with at least one noble metal sensitizer, sulfur sensitizer and/or a reduction sensitizer in place of the metal ion doping or alternatively in combination with the metal ion doping. In particular, gold sensitization and sulfur sensitization increase sensitivity.

Hereafter, unless otherwise indicated, all patents and publications are expressly incorporated by reference.

Techniques to process the silver halide constituting the central core in the manner as described above and to cover the surface of silver halide grains with silver halide forming the outer shell are known in the art, and the methods described in, for example, U.S. Pat. Nos. 3,206,313, 3,317,322, 3,367,778 (excluding a step of fogging the surface of grains), and U.S. Pat. No. 3,761,276 are advantageously employed.

The ratio of silver halide of the central core to silver halide of the outer shell cannot be delimited uniformly.

Although the silver halide of the central core and the silver halide of the outer shell preferably have the same composition, they may have different compositions. Silver halides which can be used in the invention include silver bromide, silver iodide, silver chloride, silver chlorobromide, silver bromoiodide and silver chlorobromiodide. Preferred silver halide emulsions are composed of at least 50 mol % of silver bromide. Of these emulsions, silver bromoiodide emulsions, particularly containing about 10 mol % or less of silver iodide, are most preferred.

In accordance with the process of the invention, core/shell type silver halide grains having various grain sizes can be prepared. Those core/shell type silver halide grains having an average grain size of about 0.2 to 4 microns, preferably about 0.25 to 3 microns, and particularly preferably about 0.50 to 3 microns, provide good results.

The surface chemical sensitization effect of the invention is not lost even if the core/shell type silver halide grains have a regular crystal form, such as cubic or octahedral, or an irregular crystal form, such as spherical or tabular, or a composite crystal form thereof, or are a mixture of grains having various crystal forms.

The surface of the thus prepared core/shell type silver halide grain is then chemically sensitized in the presence of the polymers of the invention. Chemical sensitization can be performed by conventional methods as described in, for example, Glafkides, *Chimie et Physique Photographique*, Paul Montel (1967), V. L. Zeilikman et al., *Making and Coating Photographic*

*Emulsion.* The Focal Press (1964), and H. Friese ed., *Die Grundlagen der Photographischen Prozesse mit Silverhalogeniden,* Akademische Verlagsgesellschaft (1968), provided that it is performed in the presence of the polymer(s) of the invention.

Thus, sulfur sensitization in which a compound containing sulfur capable of reacting with silver ions, or active gelatin is used, reduction sensitization in which a reducing substance is used, noble metal sensitization in which a noble metal or compound thereof, e.g., gold, is used, and the like can be used alone or in combination with each other.

Sulfur sensitizers which can be used include thiosulfuric acid salts, thioureas, thiazoles, and rhodanines. Representative examples of such sulfur sensitizers are described in U.S. Pat. Nos. 1,574,944, 2,410,689, 2,278,947, 2,728,668, and 3,656,955.

Reduction sensitizers which can be used include stannous salts, amines, hydrazine derivatives, formamidinesulfinic acid and silane compounds. Representative examples of reduction sensitizers are described in U.S. Pat. Nos. 2,487,850, 2,419,974, 2,518,698, 2,983,609, 2,983,610, and 2,694,637.

For noble metal sensitization, in addition to the gold complex salts, complex salts of Group VIII metals of the Periodic Table disclosed in "Kagaku Daijiten" p. 619 published by Kyoritsu Shuppan Co., Ltd. (1975), e.g., platinum, iridium, and palladium, can be used. Representative examples of such sensitizers are described in U.S. Pat. Nos. 2,399,083, 2,448,060, British Pat. No. 618,061, etc.

Of these sensitizing methods, sulfur sensitization using sulfur sensitizers provides the most preferred results. In some cases, sulfur sensitizers may be used in combination with gold complex salts. The presence of the polymers of the invention permits one to obtain good reversal photographic characteristics (maximum density (Dmax), gradation, etc.) even if the amount of the chemical sensitizer used is reduced and, therefore, it is possible to control the formation of negative images while holding good reversal photographic characteristics.

The conditions under which chemical sensitization is performed cannot be delimited uniformly. In general, however, it is preferred to effect chamical sensitization at a pH of 9 or less, a pAg of 10 or less and a temperature of at least 40° C. In some cases, chemical sensitization may be performed under conditions falling outside the above defined ranges, however.

Preferably the production of core/shell type silver halide grains and chemical sensitization of the surface of the silver halide grains are performed in the presence of protective colloids. Gelatin can be advantageously used as a protective colloid, and, in addition, other hydrophilic colloids can be used.

In order to carry out chemical sensitization of the surface of core/shell type silver halide grains in the presence of the polymer(s) of the invention, the polymers are added to an emulsion containing core/shell type silver halide grains before chemical sensitization is completed. In more detail, the polymer of the invention is added to the emulsion, at one time or in several fractions, at a suitable point after the preparation of core/shell type silver halide grains but before the completion of chemical sensitization. In particular, it is preferred to add the polymer of the invention before the addition of chemical sensitizer.

The amount of the polymer of the invention used is determined depending on various conditions such as the type of the polymer and the type of chemical sensitizer used. The effects of the invention can be obtained by adding the polymer of the invention in much smaller amounts than amounts in which it is used as a protective colloid or a binder. The amount of the polymer of the invention being used is, calculated as the weight of the repeating unit represented by the general formula (I) in the polymer, from 0.002 g to 1 g, preferably 0.002 g to 0.5 g, and more preferably from 0.002 g to 0.2 g, per mol of silver.

Several polymers such as polyvinyl pyrrolidone, included in the polymers of the invention, are sometimes used in place of gelatin for internal latent image type silver halide photographic emulsions for the purpose of increasing the covering power (ratio of optical density of an image to the amount of silver, per unit area, constituting the image). It is not known, however, that such polymers can be present in performing surface chemical sensitization of core/shell type silver halide grains to provide the effects of the invention. The effects of the invention are not obtained when the polymers are used in such large amounts as are needed to achieve an increase in covering power. Furthermore, the use of the polymers in such large amounts gives rise to the problem that color sensitization is difficult. On the contrary, when the polymers are used in such amounts that the effects of the invention are obtained, covering power does not change. It is, therefore, believed that the action of the polymer in known uses is completely different from that in the invention.

Hereinafter the polymers of the invention will be explained in more detail.

Preferred examples of repeating units represented by general formula (I) are those in which $R^1$ is a hydrogen atom, and Q is any one of formulae (i), (ii) and (iii) as set forth below:

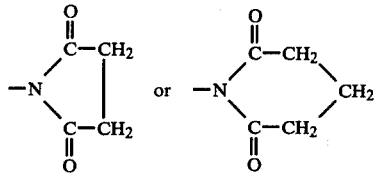

Formula (i)

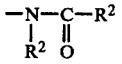

Formula (ii)

(wherein $R^2$ is a methyl group or an ethyl group, and $R^3$ is a hydrogen atom, a methyl group or an ethyl group),

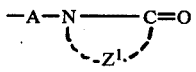

Formula (iii)

(wherein A is merely a bond or

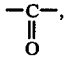

and $Z^1$ forms a 5- or 6-membered lactam or oxazolidone ring).

Particularly preferred are those in which Q is

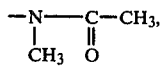

a pyrrolidone radical or an oxazolidone radical. Of these units, those in which Q is a pyrrolidone radical are most preferred.

The polymers having the repeating units represented by general formula (I) as used herein are homopolymers of a monomer represented by general formula (IA) as set forth below, copolymers of two or more such monomers, and copolymers of such monomers and other ethylenically unsaturated compounds addition copolymerizable therewith having preferably 2 to 20 carbon atoms.

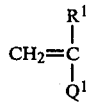

Formula (IA)

wherein $R^1$ is as defined for general formula (I), and $Q^1$ is any one of formulae (i) to (iv) below:

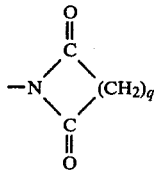

Formula (i)

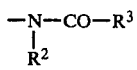

Formula (ii)

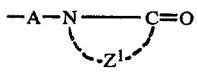

Formula (iii)

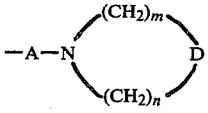

Formula (iv)

(wherein q, $R^2$, $R^3$, A, $Z^1$, D, m and n are as defined in general formula (I)).

Suitable examples of monomers represented by general formula (IA) include N-vinylsuccinimide, N-vinylglutarimide, N-vinyladipimide, N-vinylacetamide, N-methyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-ε-caprolactam, N-vinyloxazolidone, N-acryloylpyrrolidone, N-acryloyloxyethylpyrrolidone, N-acryloylmorpholine, N-acryloylpiperidine, N-methacryloylmorpholine, N-(β-morpholinoethyl)acrylamide, N-vinylmorpholine, and N-vinyl-2-pyridone.

Preferred monomers include N-vinylsuccinimide, N-vinylglutarimide, N-methyl-N-vinylacetamide, N-ethyl-N-vinylacetamide, N-vinylpyrrolidone, N-vinylpiperidone and N-vinyloxazolidone.

Particularly preferred are N-methyl-N-vinylacetamide, N-vinylpyrrolidone and N-vinyloxazolidone.

Addition copolymerizable ethylenically unsaturated compounds capable of forming copolymers in combination with monomers represented by general formula (IA) include acrylic acid, methacrylic acid, 2-hydroxyethyl acrylate, 2-methoxyethyl acrylate, sulfopropyl acrylate 2-acryloylamino-2-methylpropanesulfonic acid, hydroxyethyl acrylamide, methyl vinyl ether, sodium styrenesulfonate, N-vinyl-3,5-dimethyltriazole and maleic anhydrate, acrylic esters, methacrylic esters, acrylamides, methacrylamides, allyl compounds, vinyl ethers, vinyl esters, vinyl heterocyclic compounds, styrenes, maleic esters, fumaric esters, itaconic esters, curotonic esters, and olefins. Preferably, the monomers contain 2 to 20 carbon atoms.

Examples of such ethylenically unsaturated compounds include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl) acrylate, benzyl acrylate, cyclohexyl acrylate, phenyl acrylate; methyl methacrylate, n-propyl methacrylate, isopropyl methacrylate, n-butyl methacrylate, cyclohexyl methacrylate, 3-sulfopropyl methacrylate; allyl butyl ether, allyl phenyl ether; methyl vinyl ether, butyl vinyl ether, methoxyethyl vinyl ether, 2-hydroxyethyl vinyl ether, (2-dimethylaminoethyl)vinyl ether; vinyl phenyl ether, vinyl chlorophenyl ether, acrylamide, methacrylamide, N-methylacrylamide, N-(1,1-dimethyl-3-oxobutyl)acrylamide, N-(1,1-dimethyl-3-hydroxybutyl)acrylamide, N,N-dimethylacrylamide, acryloylhydrazine, N-methoxymethylmethacrylamide, N-(1,1-dimethyl-3-hydroxybutyl)methacrylamide, N-hydroxymethylacrylamide; vinylpyridine, N-vinylimidazole, N-vinylcarbazole, vinylthiophene; styrene, chloromethylstyrene, p-acetoxystyrene, p-methylstyrene; p-vinylbenzoic acid, methyl p-vinylbenzoate; crotonamide, butyl crotonate, glycerine monocrotonate; methyl vinyl ketone, phenyl vinyl ketone; ethylene, propylene, 1-butene, dicyclopentadiene, 4-methyl-1-hexene, 4,4-dimethyl-1-pentene; methyl itaconate, ethyl itaconate, diethyl itaconate; methyl sorbitate, ethyl maleate, butyl maleate, dibutyl maleate, octyl maleate; ethyl fumarate dibutyl fumarate, octyl fumarate; halogenated olefins, e.g., vinyl chloride, vinylidene chloride, chloroprene; unsaturated nitriles, e.g., acrylonitrile and methacrylonitrile. If desired or necessary, these compounds can be used as mixtures comprising two or more thereof.

Ethylenically unsaturated compounds which are preferred in view of the hydrophilic properties of the polymers formed therefrom, etc., include acrylic acid, methacrylic acid, 2-hydroxyethyl acrylate, 2-methoxyethyl acrylate, 2-methoxyethyl acrylate, sulfopropyl acrylate, acrylamide, dimethylacrylamide, 2-acryloylamino-2-methylpropanesulfonic acid, hydroxyethylacrylamide, methyl vinyl ether, sodium styrenesulfonate, N-vinyl-3,5-dimethyltriazole and maleic anhydride.

The proportions of components in the copolymers having the repeating unit represented by the general formula (I) are subject to no special limitations. In general, however, the component represented by general formula (I) preferably constitutes 10 to 100 mol% (exclusive), partcularly preferably 50 to 100 mol % (exclusive).

Homo- and co-polymers having the repeating units represented by general formula (I) can be prepared by the methods described in, for example, British Pat. No. 1,211,039, Japanese Patent Publication No. 29195/1972, Japanese Patent Application (OPI) Nos. 76593/1973, 92022/1973, 21134/1974, 120634/1974, British Pat. No. 961,395, U.S. Pat. Nos. 3,227,672, 3,290,417, 3,262,919, 3,245,932, 2,681,897, 3,230,275, John C. Petropoulos et al., *Official Digest*, 33, pp. 719 to 736 (1961), S. Murahashi et al., ed., *Gosei Kobunshi* (*Synthetic Polymers*), 1, pp. 246 to 290, and 3, pp. 1 to 108. Of course, various conventional modifications can be made to the polymerization initiator, concentration, polymerization temperature, reaction time, and so forth, depending on the type of the polymer to be prepared.

For example, the polymerization is usually performed at 20° to 180° C., preferably at 40° to 120° C., in the presence of 0.05 to 5% by weight, based on the weight of the monomer to be polymerized, of a radical polymerization initiator. Initiators which can be used include azobis compounds, peroxides, hydroperoxides, and redox catalysts, e.g., potassium persulfate, tert-butyl peroctoate, benzoyl peroxide, azobisisobutyronitrile, 2,2'-azobiscyanovaleric acid and 2,2'-azobis-(2-amidinopropane hydrochloric acid salt).

The molecular weight of the polymer used herein is usually at least about 2,000, preferably from about 8,000 to about 700,000, although it is not critical for obtaining the effects of the invention.

Typical examples of polymers having repeating units represented by general formula (I), which can be used in the invention, are set forth below:

(1) Poly(N-vinylpyrrolidone)
(2) Poly(N-vinyloxazolidone)
(3) Poly(N-vinylsuccinimide)
(4) Poly(N-vinylglutarimide)
(5) Poly(N-vinylpiperidone)
(6) Poly(N-vinyl-ε-caprolactam)
(7) Poly(N-methyl-N-vinylacetamide)
(8) Poly(N-ethyl-N-vinylacetamide)
(9) Poly(N-vinylacetamide)
(10) Vinyl alcohol/N-vinylacetamide copolymer (molar ratio: 30/70)
(11) Vinyl alcohol/N-vinylpyrrolidone copolymer (molar ratio: 20/80)
(12) Vinyl alcohol/N-vinylpyrrolidone copolymer (molar ratio: 30/70)
(13) N-Vinylpyrrolidone/vinyl acetate copolymer (molar ratio: 70/30)
(14) N-Vinylpyrrolidone/2-hydroxyethylacrylate copolymer (molar ratio: 70/30)
(15) N-Vinylpyrrolidone/acrylic acid copolymer (molar ratio: 90/10)
(16) N-Vinylpyrrolidone/N-vinyl-3,5-dimethyltriazole copolymer (molar ratio: 50/50)
(17) N-Vinylpiperidone/2-methoxyethyl acrylate copolymer (molar ratio: 70/30)
(18) N-Vinylpiperidone/methyl vinyl ether copolymer (molar ratio: 90/10)
(19) N-Vinyloxazolidone/vinyl alcohol copolymer (molar ratio: 65/35)
(20) N-Vinyloxazolidone/acrylic acid copolymer (molar ratio: 80/20)
(21) N-Vinylpyrrolidone/N-vinylpiperidone/2-hydroxyethyl acrylate copolymer (molar ratio: 40/30/30)
(22) Vinyl alcohol/vinyl acetate/N-vinyl-2-pyridone copolymer (molar ratio: 70/25/5)
(23) N-Vinylpyrrolidone/2-hydroxyethyl acrylate/-vinyl acetate copolymer (molar ratio: 70/20/10)
(24) N-Vinylpyrrolidone/vinyl alcohol/vinyl propionate/sodium styrenesulfonate copolymer (molar ratio: 40/40/5/15)
(25) N-Vinylpyrrolidone/acrylamide copolymer (molar ratio: 60/40)
(26) N-Vinylpyrrolidone/2-acrylamide/2-methylpropane-sulfonic acid copolymer (molar ratio: 75/25)
(27) N-Vinylpiperidone/acrylamide copolymer (molar ratio: 60/40)
(28) N-Vinyloxazolidone/N-(2-hydroxyethyl)acrylamide copolymer (molar ratio: 70/30)
(29) N-Vinylpyrrolidone/N-vinylmorpholine/acrylamide copolymer (molar ratio: 50/20/30)
(30) N-Vinylsuccinimide/N-vinyl-ε-caprolactam/acrylamide copolymer (molar ratio: 40/20/40)
(31) N-Vinyloxazolidone/acrylamide/acrylic acid copolymer (molar ratio: 60/20/20)
(32) N-Vinylpyrrolidone/acrylamide/-vinylacetate/acrylic acid copolymer (molar ratio: 60/20/10/10)
(33) N-Vinylpyrrolidone/dimethylacrylamide copolymer (molar ratio: 70/30)

The internal latent image type silver halide photographic emulsion of the invention may be subjected to spectral sensitization using methine dyes and the like. In addition to methine dyes, cyanine dyes, merocyanine dyes, composite cyanine dyes, composite merocyanine dyes, holopolar cyanine dyes, hemicyanine dyes, styryl dyes and hemioxonol dyes can be used for spectral sensitization. Particularly useful dyes are the cyanine dyes, merocyanine dyes and composite merocyanine dyes. These dyes can comprise any of nuclei as the ordinarily used in cyanine dyes as basic heterocyclic nuclei. Nuclei which can be used include a pyrroline nucleus, an oxazoline nucleus, a thiazoline nucleus, a selenazole nucleus, an imidazole nucleus, a tetrazole nucleus, a pyridine nucleus, etc.; nuclei resulting from the fusing of alicyclic hydrocarbon rings to the foregoing nuclei; and nuclei resulting from the fusing of aromatic hydrocarbon rings to the foregoing nuclei, e.g., an indolenine nucleus, a benzindoleine nucleus, an indole nucleus, a benzoxazole nucleus, a naphthoxazole nucleus, a benzotriazole nucleus, a naphthothiazole nucleus, a benzoselenazole nucleus, a benzimidazole nucleus and a quinoline nucleus. These nuclei may be substituted at a carbon atom thereof.

As nuclei having the ketomethylene structure which is contained in the merocyanine dyes and composite merocyanine dyes can be applied 5- and 6-membered heterocyclic nuclei, such as a pyrazoline-5-on nucleus, a thiohydantoin nucleus, a 2-thiooxazolidine-2,4-dion nucleus, a thiazolidine-2,4-dion nucleus, a rhodanine nucleus and a thiobarbituric acid nucleus.

Useful sensitizing dyes are described in, for example, German Pat. No. 929,080, U.S. Pat. Nos. 2,231,658, 2,493,748. 2,503,776, 2,519,001, 2,912,329, 3,655,394, 3,656,959, 3,672,897, 3,694,217, British Pat. No. 1,242,588, and Japanese Patent Publication No. 14030/1969.

These sensitizing dyes may be used in combination with each other, although they may also be used singly. Combinations of such sensitizing dyes are often used particularly for the purpose of super sensitization. Typical examples of such sensitizing dyes are described in, for example, U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Pat. No. 1,344,281, and Japanese Patent Publication No. 4936/1968.

The emulsion of the invention may have incorporated therein dyes which do not have any spectral sensitization effect per se, or substances which do not substantially absorb visible light, but which show super sensitization, along with the above described dyes. Examples include aminostilbene compounds substituted by nitrogen-containing heterocyclic ring groups, as described in, for example, U.S. Pat. Nos. 2,933,390 and 3,635,721, aromatic organic acids/formaldehyde condensates, as described in, for example, U.S. Pat. No. 3,743,510, cadmium salts and azaindene compounds. Combinations as described in U.S. Pat. Nos. 3,615,613, 3,615,641, 3,617,295, and 3,635,721 are particularly useful.

The above described polymers for use in the internal latent image silver halide photographic emulsion of the invention do not interfere with color sensitization by the foregoing sensitizing dyes since the polymer is used only in a small amount.

The direct positive silver halide photographic emulsions of the invention can be dispersed in various colloids which are known vehicles in this field. Some vehicles which are suitable for use are described in, for example *Research Disclosure,* Vol. 176, page 26, "Vehicles and Vehicle Extenders". Of such vehicles, gelatin is particularly preferred.

In preparing a light-sensitive material using the internal latent image type silver halide photographic emulsions of the invention, the emulsion is coated on a support, if necessary, along with other photographic layers. Although the amount of the emulsion coated is not critical, desirable reversal images are obtained when the emulsion is coated so that the amount of silver per square foot of the support is from about 40 mg to about 800 mg. Supports as described in *Product Licensing Index,* Vol. 92, page 108, "Supports" can be used in the invention.

The internal latent image silver halide photographic emulsion of the invention may contain, for the purpose of increasing sensitivity and contrast, and of accelerating development, polyalkyleneoxides or ether, ester, amine and like derivatives thereof, thioether compounds thiomorpholines, quaternary ammonium salt compounds, urethane derivatives, urea derivatives, imidazole derivatives, 3-pyrazolidones, and the like: The compounds described in, for example, U.S. Pat. Nos. 2,400,532, 2,423,549, 2,716,062, 3,617,280, 3,772,021, and 3,808,003 are useful.

The internal latent image type silver halide photographic emulsion of the invention may contain antifoggants and stabilizers. Such antifoggants and stabilizers are described in, for example, *Product Licensing Index,* Vol. 92, page 107, "Antifoggants and Stabilizers".

The internal latent image type silver halide photographic emulsion of the invention can contain developing agents. Those developing agents as described in *Product Licensing Index,* Vol. 92, pp. 107 to 108, "Developing Agents" can be used in the invention.

The internal latent image type silver halide photographic emulsion of the invention can be dispersed in colloids which can be hardened with various organic or inorganic hardeners. Those hardeners as described in *Product Licensing Index,* Vol. 92, page 108, "Hardeners" can be used in the invention.

The internal latent image type silver halide photographic emulsion of the invention can contain coating aids. As such coating aids, those described in *Product Licensing Index,* Vol. 92, page 108, "Coating Aids" can be used.

The internal latent image type silver halide photographic emulsion of the invention can contain color couplers. As such color couplers, those described in *Product Licensing Index,* Vol. 92, page 11, "Color Materials" can be used.

The internal latent image type silver halide photographic emulsion of the invention can contain antistatic agents, plasticizers, matting agents, lubricants, ultraviolet absorbers, fluorescent brightening agents, air fog-preventing agents, and so forth.

The light-sensitive material prepared using the internal latent image silver halide photographic emulsion of the invention may contain dyes as filter dyes or for the purpose of preventing irradiation and so forth in the photographic emulsion layer, or other hydrophilic colloid layers thereof. As such dyes, those described in *Product Licensing Index,* Vol. 92, page 109, "Absorbing and Filter Dyes" can be used.

The internal latent image type silver halide photographic emulsion of the invention is developed in the presence of fogging agents (nucleation agents) or is developed while applying over-all exposure thereto to produce a reversal image.

Fogging agents which can be used include hydrazines as described in U.S. Pat. Nos. 2,588,982 and 2,563,785, hydrazides and hydrazones as described in U.S. Pat. No. 3,227,552, quaternary salt compounds as described in Japanese Patent Publication No. 38164/1974, U.S. Pat. Nos. 3,615,615, 3,719,494, 3,734,738, 4,094,683, and 4,115,122, sensitizing dyes as described in U.S. Pat. No. 3,718,470, containing nucleating substituents in the molecule thereof, and acylhydrazinodiphenylthiourea-based compounds as described in U.S. Pat. Nos. 4,030,925 and 4,031,127. In addition, those compounds as described in, for example, U.S. Pat. No. 4,139,387, and Japanese Patent Application (OPI) Nos. 133126/1979 and 74729/1979 can be used.

The fogging agent as used herein is desirably added in an amount to provide a sufficient maximum density when the internal latent image type silver halide emulsion of the invention is developed with a surface developer such as Developer B above. Preferably, the fogging agent is incorporated into the photographic emulsion layer or layers adjacent thereto.

The internal latent image type silver halide photographic emulsion of the invention can be used in various applications. Particularly, it is advantageously used as an emulsion for a direct positive type photographic light-sensitive material, an emulsion in a multi-layer reversal color element, and as an emulsion in a multi-layer color diffusion transfer element.

The photographic emulsion of the invention can be used in combination with a color image-providing substance for diffusion transfer which is capable of releasing a diffusible dye corresponding to the development of silver halide to obtain a transferred image in a conventional image-receiving layer after suitable development processing. A number of such color image-producing substances for diffusion transfer are known, and those substances which can be used in the invention are described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, 4,013,635, U.S. T. No. 351,673, British Pat. Nos. 840,731, 904,364, 1,038,331, West German Patent Application (OLS) Nos. 1,930,215, 2,214,381, 2,228,361, 2,317,134, 2,402,900, French Pat. No. 2,284,140, Japanese Patent Application (OPI) Nos. 113624/1976 (corresponding to U.S. Pat. No. 4,055,428), 1,04343/1976 and 143323/1978, and U.S. Pat. No. 4,268,625. Of these substances, it is preferred to use color image producing substances of the type that are initially non-diffusing but after oxidation-reduction reaction with an oxidation product of a developing agent, split to release a diffusing dye (hereinafter these substances are referred to as "DRR compounds").

Compounds which are preferaably used in combination with the photographic emulsion of the invention are DRR compounds having an o-hydroxyarylsulfamoyl group as described in Japanese Patent Application (OPI) No. 113624/1976 and DRR compounds containing a redox host nucleus as described in U.S. Pat. No. 4,268,625. The use of such DRR compounds in combination with the photographic emulsion of the invention markedly reduces temperature dependency, in particular, during processings.

Suitable examples of such DRR compounds include, in addition to the foregoing compounds, 1-hydroxy-2-tetramethylenesulfamoyl-4-[3'-methyl-4'-(2''-hydroxy-4''-methyl-5''-hexadecyloxyphenylsulfamoyl)-phenylazo]naphthalene as a magenta dye image-forming substance, and 1-phenyl-3-cyano-4-(3'-[2''-hydroxy-4''-methyl-5''-(2''',4'''-di-tert-pentylphenoxyacetamido)-phenylsulfamoyl]phenylazo)-5-pyrazolone as a yellow dye image-forming substance.

Various known developing agents can be used for developing the light-sensitive material of the invention. For example, polyhydroxybenzenes, e.g., hydroquinone, 2-chlorohydroquinone, 2-methylhydroquinone, catechol, and pyrogallol, aminophenols, e.g., p-aminophenol, N-methyl-p-aminophenol and 2,4-diaminophenol, 3-pyrazolidones, e.g., 1-phenyl-3-pyrazolidones, 3,3-dimethyl-1-phenyl-3-pyrazolidone and 5,5-dimethyl-1-phenyl-3-pyrazolidone, ascorbic acids, etc., can be used alone or in combination with each other.

For the preparation of dye images in the presence of dye-forming couplers, aromatic primary amine developing agents, preferably p-phenylenediamine-based developing agents, can be used. Representative examples are 4-amino-3-methyl-N,N-diethylaniline hydrochloride, N,N-diethyl-p-phenylenediamine, 3-methyl-4-amino-N-ethyl-N-β-(methane-sulfoamido)ethylaniline, 3-methyl-4-amino-N-ethyl-N-(β-sulfoethyl)aniline, 3-ethoxy-4-amino-N-ethyl-N-(β-sulfoethyl)aniline, and 4-amino-N-ethyl-N-(β-hydroxyethyl)aniline. These developing agents may be contained in an alkaline processing composition (processing element) or may be contained in a suitable layer of the light-sensitive material such as emulsion layer or other hydrophilic colloid layer.

When DRR compounds are used in the invention, any silver halide developers can be used as long as they can cross-oxidize the DRR compounds.

The developer as used herein may contain, as preservatives, sodium sulfite, potassium sulfite, ascorbic acid, reductones, e.g., piperizinohexose reductone, and the like.

The light-sensitive material of the invention can provide direct positive images on developing with a surface developer. When a surface developer is used, development is induced substantially by latent images or fog nuclei existing on the surface of silver halide particles. Although it is preferred the developer does not contain silver halide-dissolving agent, the developer may contain a small amount of silver halide-dissolving agent (e.g., this sulfuric acid salts) as long as any internal latent image present does not substantially contribute to image formation until surface development of silver halide particles is substantially completed.

The developer used herein may contain, as alkali agents and buffers, sodium hydroxide, potassium hydroxide, sodium carbonate, potassium carbonate, trisodium phosphate, sodium metaborate and the like. These agents are generally added in an amount to adjust the developer pH to 10 to 13, preferably pH 11 to 12.5.

The developer used herein may contain a color development accelerator, e.g., benzyl alcohol. Furthermore, in order to lower the minimum density of a direct positive image, it is advantageous for the developer to contain, for example, benzimidazoles, e.g., 5-nitrobenzimidazole, and benzotriazoles, e.g., benzotriazole and 5-methylbenzotriazole, which are usually used as antifoggants.

The light-sensitive material of the invention can be processed with a viscous developer. Such a viscous developer is a liquid composition containing components which are necessary for the development of a silver halide emulsion and the formation of diffusion transfer dye images. It is mainly composed of water but sometimes contains hydrophilic solvents such as methanol and methyl cellosolve. The liquid composition contains an alkali in an amount sufficient to maintain the pH at a level causing development of the emulsion layer and neutralizing acids formed during development and processings for the formation of dye images (e.g., hydrohalogenic acids, such as hydrobromic acid, and carboxylic acids, such as acetic acid). Alkalis which can be used for such purpose include alkali or alkaline earth metal salts, e.g., lithium hydroxide, sodium hydroxide, potassium hydroxide, a calcium hydroxide dispersion, hydroxy tetramethyl ammonium, sodium carbonate and trisodium phosphate, and amines, e.g., diethylamine. The concentration of caustic alkali in the liquid composition is desirably such that the pH of the composition (at room temperature) is preferably at least about 12 and particularly preferably at least about 14. More preferably the liquid composition contains high molecular weight hydrophilic polymers such as polyvinyl alcohol, hydroxyethyl cellulose and sodium carboxymethyl cellulose. It is preferred that these polymers are added to the processing composition so that the resultant processing composition has a viscosity of at least 1 poise, preferably several hundred (500 to 600) to 1,000 poises, at room temperature.

It is advantageous for the processing composition to contain, in addition to the foregoing ingredients, light-absorbing substances such as $TiO_2$, carbon black and a pH indicating dye to prevent the silver halide emulsion from being fogged by exterior light during or after the processing, and desensitizing agents as described in U.S. Pat. No. 3,579,333, in particular when the processing composition is used in a monosheet film unit. In addition, development inhibitors, e.g., benzotriazole, can be added to the processing composition.

Preferably the processing composition is placed in a rupturable container as described in, for example, U.S. Pat. Nos. 2,543,181, 2,643,886, 2.653,732, 2,723,051, 3,056,491, 3,056,492 and 3,152,515.

When the light-sensitive material of the invention is used in a diffusion transfer photographic process, it is preferred that it be used in the form of a film unit. Such a photographic film unit, i.e., a film unit which is designed so that it can be processed by passage between a pair of pressing members which are placed in parallel, basically comprises the following three elements:

(1) a light-sensitive element containing a fogging agent;

(2) an image-receiving element; and (3) a processing element.

The processing element contains a means to release the alkaline processing composition in the interior of the film unit, e.g., a rupturable container, and, at the same time, the silver halide developer.

Such a photographic film unit is preferably of the type where the above elements are superposed on each other and combined together, as disclosed in Belgian Pat. No. 757,959. In the preparation of photographic film units of such a type, an image-receiving layer, a substantially opaque light reflection layer (e.g., a $TiO_2$ layer and a carbon black layer) and a light-sensitive element comprising one or a plurality of silver halide light-sensitive layers in which a DRR compound is used in combination are coated on one transparent support in that sequence, and, additionally, a transparent cover sheet is placed thereon in the face-to-face relation. A rupturable container containing an alkaline processing composition which renders the same opaque (e.g., carbon black) is placed adjacent the uppermost layer of the light-sensitive layer and the transparent cover sheet so that it can spread the content (processing composition) therebetween.

The film unit thus prepared is exposed to light through the transparent cover sheet. Upon removing the film unit from a camera, the container is broken by the pressing members—typically rollers—to extend the processing composition (containing the opacifying agent) between the protective layer on the light-sensitive layer and the cover sheet. As a result, the film unit is shielded from light and development proceeds. Preferably the cover sheet is prepared by coating a neutralization layer and, if desired or necessary, a neutralization rate-controlling layer (a timing layer) on a support in that sequence.

Other useful laminated units in which a DRR compound and a diffusing dye-releasing coupler can be used are described in, for example, U.S. Pat. Nos. 3,415,644, 3,415,645, 3,415,646, 3,647,487, and 3,635,707 and West German Patent Application (OLS) No. 2,426,980.

The process of the invention permits one to obtain an internal latent image type silver halide photographic emulsion which produces a reversal image having high Dmax, excellent image descrimination and a hard tone by performing chemical sensitization of the surface of core/shell type silver halide particles in the presence of the polymer of the invention.

The internal latent image type silver halide photographic emulsion prepared by the process of the invention has excellent stability with the passage of time, and, therefore, deterioration of the quality thereof does not occur even if it is stored for a long period of time. Furthermore, the internal latent image type silver halide emulsion prepared by the process of the invention is improved with respect to low illumination reciprocity law failure characteristics and provides a negative image of low sensitivity, and, therefore, the formation of false images at high illumination areas does not occur.

The following examples are given to illustrate the invention in greater detail.

In the following examples, the polymers of the invention have molecular weights as shown below.

In the following examples the polymers having repeating units represented by general formula (I) of the invention have molecular weight shown below.

| Polymer | | Average Molecular Weight |
|---|---|---|
| (1) | Poly(N—vinylpyrrolidone) | about 10,000 |
| (2) | Poly(N—vinyloxazolidone) | about 20,000 |
| (6) | Poly(N—vinyl-ε-caprolactam) | about 40,000 |
| (7) | Poly(N—methyl-N—vinylacetamide) | about 50,000 |
| (11) | Vinyl alcohol/N—vinylpyrrolidone copolymer (molar ratio: 20/80) | about 120,000 |
| (12) | Vinyl.alcohol/N—vinylpyrrolidone copolymer (molar ratio: 3O/70) | about 100,000 |
| (13) | N—vinylpyrrolidone/vinylacetate copolymer | about 100,000 |
| (14) | N—vinylpyrrolidone/2-hydroxyethyl acrylate copolymer (molecular ratio: 70/30) | about 200,000 |

EXAMPLE 1

An aqueous solution of potassium bromide and an aqueous solution of silver nitrate were added simultaneously to an aqueous solution of gelatin at 75° C. over a period of about 100 minutes while vigorously stirring to prepare a silver bromide emulsion having an average grain size of about 1.3 microns. To the thus prepared silver bromide grains were added 2.5 mg per mol of silver of sodium thiosulfate and 1.2 mg per mol of silver of sodium chloroaurate; the resultant mixture was then heated at 75° C. for 80 minutes to perform chemical sensitization. To 1 mol of the grains thus sensitized were added $AgNo_3$ and KBr simultaneously in 40 minutes at 75° C. to allow formation of outer shells on the grains, whereby the average grain diameter reached 1.5 microns. This emulsion is designated as core/shell type direct reversal emulsion A.

To emulsion A thus prepared were added sodium thiosulfate and, in certain runs one of polymers (1), (2), (12) or (13) as earlier identified containing a repeating unit represented by the general formula (I), amounts being given in Table 1. The resultant mixture was heated at 60° C. for 60 minutes to chemically sensitize the surface of grains. Emulsions prepared by applying such surface chemical sensitization in the manner shown in Experiment No. 2 of Table 1 and by applying such surface chemical sensitization in the manner shown in Experiment No. 3 of Table 1 were designated as emulsion (1) and emulsion (2), respectively.

A fogging agent having the formula:

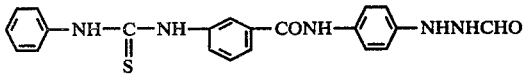

was added to each of the above-described emulsion in an amount of 6.8 mg per mol of silver, and the resultant mixture was coated on a cellulose acetate film support in such an amount that silver and gelatin were 400 mg/ft$^2$ and 656 mg/ft$^2$, respectively, to prepare a light-sensitive material.

Each light-sensitive material was exposed to light through an optical wedge for 1/10 second by the use of a 400 lux tungsten lamp. Also, each light-sensitive material was exposed to light through an optical wedge for 1/100 second by the use of a $5.5\times10^4$ lux xenon lamp to see if negative images were formed by high illumination short period exposure.

The thus exposed materials were each developed with developer X having the formulation set forth hereinafter. For each light-sensitive material, the maximum density (Dmax) and the minimum density (Dmin) of the reversal image obtained were measured. The amount of developed silver at the maximum density area of the reversal image was measured to determine its covering power. For the light-sensitive material exposed to light by the use of the xenon flash lamp, the sensitivity of the negative image was measured. The results are shown in Table 1.

| Developer X | Amount (g) |
|---|---|
| Sodium sulfite | 30 |
| Hydroquinone | 10 |
| 1-Phenyl-4-methyl-4-hydroxymethyl-3-pyrazolidinone | 0.75 |
| Trisodium phosphate | 40 |
| Potassium hydroxide | 10.7 |
| 5-Methylbenzotriazole | 0.02 |
| Water to make | 1 liter |

TABLE 1

| Experiment No. | Polymer | Amount of Polymer (mg/Ag mol) | Sodium Thiosulfate (mg/Ag mol) | Dmax | Dmin | Covering Power ($cm^2/\mu g$) ($\times 10^{-3}$) | Srel.* (negative image) |
|---|---|---|---|---|---|---|---|
| 1 | not used | — | 0.34 | 0.20 | 0.09 | 3.2 | 100 |
| 2 (Emulsion (1)) | not used | — | 1.36 | 0.88 | 0.11 | 3.3 | 270 |
| 3 (Emulsion (2)) | (1) | 68 | 0.34 | 1.13 | 0.09 | 3.3 | 190 |
| 4 | (2) | 68 | 0.34 | 0.55 | 0.09 | 3.2 | 108 |
| 5 | (12) | 68 | 0.34 | 0.63 | 0.08 | 3.3 | 142 |
| 6 | (13) | 68 | 0.34 | 0.71 | 0.08 | 3.3 | 158 |

*Srel.: The relative value of photographic sensitivity at a density greater by 0.2 than Dmin.

The following can be seen from Table 1.

With the light-sensitive material prepared using an emulsion which was subjected to surface chemical sensitization in the presence of a polymer containing the repeating unit represented by general formula (I), the Dmax of the reversal image was high and the Dmin was low. Also, covering power was nearly the same as that of the control light-sensitive material which was prepared in the absence of the polymer. Furthermore, negative image sensitivity could be maintained at a lower level compared to the control light-sensitive material, even when Dmax was nearly the same.

EXAMPLE 2

An emulsion was prepared in the same manner as for the preparation of emulsion A with the exception that the second silver halide precipitation to form the shell was performed in the presence of 2.3 mols of potassium iodide (KI). This emulsion was a core/shell type direct reversal AgBrI emulsion, which was designated emulsion B. This emulsion B was subjected to surface chemical sensitization in the same manner as in Example 1 except that the polymers of this invention shown in Table 2 below were used.

It can be seen from Table 2 that with the light-sensitive material prepared using an emulsion which was subjected to surface chemical sensitization in the presence of a polymer containing the repeating unit represented by general formula (U), Dmax of the reversal image was high and the Dmin was low.

TABLE 2

| Experiment No. | Polymer | Amount of Polymer (mg/Ag mol) | Sodium Thiosulfate (mg/Ag mol) | Maximum Density | Minimum Density |
|---|---|---|---|---|---|
| 7 | not used | — | 0.28 | 0.10 | 0.08 |
| 8 | not used | — | 1.13 | 0.61 | 0.12 |
| 9 | (2) | 85 | 0.28 | 0.98 | 0.16 |
| 10 | (6) | 85 | 0.28 | 0.42 | 0.10 |
| 11 | (1) | 85 | 0.28 | 1.04 | 0.12 |
| 12 | (7) | 85 | 0.28 | 0.76 | 0.10 |
| 13 | (12) | 85 | 0.28 | 0.94 | 0.12 |
| 14 | (14) | 85 | 0.28 | 0.72 | 0.08 |
| 15 | (13) | 85 | 0.28 | 0.76 | 0.09 |
| 16 | (11) | 85 | 0.28 | 0.83 | 0.10 |

EXAMPLE 3

A core/shell type direct reversal emulsion was prepared in the same manner as in Example 1 with the exception that the final grain size was about 1.0 micron. This emulsion was designated emulsion C.

To emulsion C were added a polymer of the invention and sodium thiosulfate or only sodium thiosulfate as shown in Table 3. The resultant mixtures were heated at 60° C. for 60 minutes to chemically sensitize the surface of the grains, preparing emulsion (3) and emulsion (4). Emulsions (3) and (4) were each coated in the same manner as in Example 1 to prepare a light-sensitive material. Each light-sensitive material was subjected to accelerated storage testing by storage at 60° C. and 10% RH for 3 days or at 45° C. and 80% RH for 3 days. Thereafter, the materials were exposed to light and developed in the same manner as in Example 1, and the Dmax and Dmin thereof measured. The results are shown in Table 3.

TABLE 3

| Experiment No. | Polymer | Amount of Polymer (mg/Ag mol) | Sodium Thiosulfate (mg/Ag mol) | Storage Conditions | Dmax | Dmin |
|---|---|---|---|---|---|---|
| 17 (Emulsion (3)) | not used | | 1.70 | not subjected to accelerated storage | 1.04 | 0.24 |
| | | | | 60° C., 10% RH, 3 days | 1.00 | 0.30 |
| | | | | 45° C., 80% RH, 3 days | 0.38 | 0.19 |
| 18 | (1) | 68 | 0.34 | not subjected to | 0.94 | 0.06 |

TABLE 3-continued

| Experiment No. | Polymer | Amount of Polymer (mg/Ag mol) | Sodium Thiosulfate (mg/Ag mol) | Storage Conditions | Dmax | Dmin |
|---|---|---|---|---|---|---|
| (Emulsion (4)) | | | | accelerated storage | | |
| | | | | 60° C., 10% RH, 3 days | 0.90 | 0.06 |
| | | | | 45° C., 80% RH, 3 days | 0.48 | 0.11 |

As is apparent from Table 3, after accelerated storage testing at 45° C. and 80% RH for 3 days, the reduction in the Dmax of the emulsion (3) sample was low as compared with that of the emulsion (4) sample, and the increase in the Dmin of the emulsion (3) sample was low as compared with that of the emulsion (4) sample. Thus, it can be seen that the core/shell type direct reversal emulsion which was subjected to surface chemical sensitization in the presence of the polymer containing the repeating unit represented by general formula (I) had improved stability with time.

EXAMPLE 4

To emulsion C prepared as per Example 3 were added 0.34 mg per mol of silver of sodium thiosulfate and 0.17 mg per mol of silver of potassium chloroaurate: the resultant mixture was heated at 75° C. for 80 minutes to perform surface chemical sensitization and yield emulsion (5).

Also, 0.34 mg of sodium thiosulfate, 0.17 mg of potassium chloroaurate, and 85 mg of Polymer (1) to the invention, each per mol of the silver, were added to emulsion C, and the resultant mixture was heated at 60° C. for 60 minutes to perform surface shemical sensitization and yield emulsion (6). Emulsions (5) and (6) were each coated and exposed to light in the same manner as in Example 1, and Dmax and Dmin measured.

The results are shown in Table 4.

TABLE 4

| Experiment No. | Polymer | Dmax | Dmin |
|---|---|---|---|
| 19 (Emulsion (5)) | — | 0.76 | 0.12 |
| 20 (Emulsion (6)) | (1) | 1.98 | 0.09 |

With the core/shell type direct reversal emulsion which was subjected to surface chemical sensitization (gold sensitization and sulfur sensitization) in the presence of the polymer having the repeating unit represented by the general formula (I), Dmax was high and Dmin was low.

EXAMPLE 5

On a transparent polyethylene terephthalate support were coated the layers set forth below in the following sequence to prepare two light-sensitive sheets (A) and (B).

(1) A mordant layer containing a polymer (3.0 g/m$^2$) disclosed in U.S. Pat. No. 3,898,088 having the repeating unit shown below, and gelatin (3.0 g/m$^2$).

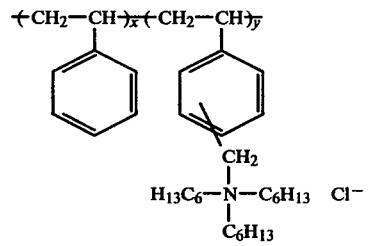

X:Y = 50:50

(2) A white reflection layer containing titanium oxide (20 g/m$^2$) and gelatin (2.0 g/m$^2$)

(3) A light-shielding layer containing carbon black (2.70 g/m$^2$) and gelatin (2.70 g/m$^2$)

(4) A layer containing a magenta DRR compound as shown below (0.45 g/m$^2$), diethyllaurylamide (0.10 g/m$^2$), 2,5-di-tert-butylhydroquinone (0.0074 g/m$^2$) and gelatin (0.76 g/m$^2$)

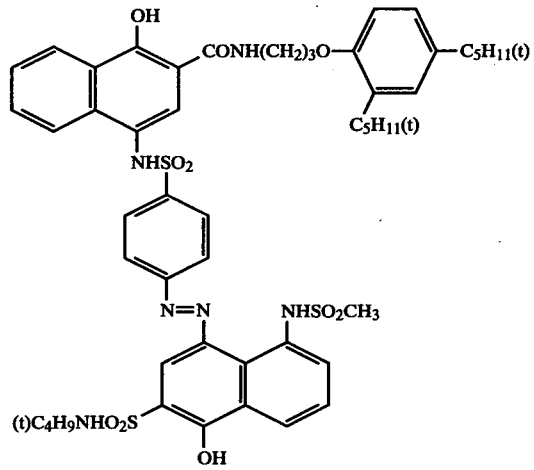

(5) A green-sensitive internal latent image type direct positive silver bromide layer containing an emulsion as shown below (1.6 g/m$^2$ as silver), a green-sensitive sensitizing dye, the same fogging agent as used in Example 1 (0.05 mg/m$^2$), and sodium 5-pentadecyl-hydroquinone-2-sulfonate (0.11 g/m$^2$)

Light-sensitive sheet (A): Emulsion (1) defined in Example 1

Light-sensitive sheet (B): Emulsion (2) defined in Example 1

(6) A layer containing gelatin (0.96 g/m$^2$)

Light-sensitive sheets (A) and (B) were processed in combination with the following elements.

| Processing Liquid | |
|---|---|
| 1 Phenyl-4-methyl-4-hydroxymethyl-3-pyrazolidinone | 10 g |
| Methylhydroquinone | 0.18 g |
| 5-Methylbenzotriazole | 4.0 g |
| Sodium sulfite (anhydrous) | 1.0 g |
| Carboxymethyl cellulose sodium salt | 40.0 g |
| Carbon black | 150 g |
| Potassium hydroxide (28% aqueous solution) | 200 ml |
| Water | 550 ml |

Containers capable of being broken by pressure were charged with 0.8 g portions of the processing liquid having the above formulation.

Cover Sheet

On a polyethylene terephthalate support were coated polyacrylic acid (15 g/m$^2$, a 10% by weight aqueous solution having a viscosity of about 1,000 cps) as an acidic polymer layer (a neutralization layer), and acetyl cellulose (3.8 g/m$^2$, hydrolysis of 100 g of the acetyl cellulose produced 39.4 g of acetyl groups) and a styrene-maleic anhydride copolymer (0.2 g/m$^2$, styrene/-maleic anhydride (mole ratio)=about 60/40, molecular weight=about 50,000) as a neutralization timing layer, in that sequence, to prepare a cover sheet.

Processing Step

The cover sheet was superposed on the light-sensitive sheet, and light-exposure was applied through a color test chart from the cover sheet side. The processing liquid was then extended between the color sheet and the light-sensitive sheet in a thickness of 75 microns by the use of press rolls. Processing was performed at 25° C. One hour after processing, the green density of the image formed in the image-receiving layer was measured through the transparent support of the light-sensitive sheet using a Macbeth reflection densitometer. The results are shown in Table 5.

TABLE 5

| Light-Sensitive Element | Dmax. | Dmin |
|---|---|---|
| (A) | 1.82 | 0.32 |
| (B) | 2.01 | 0.30 |

It is apparent from the results shown in Table 5 that the internal latent image type emulsion prepared by the process of the invention showed a high Dmax and a low Dmin.

EXAMPLE 6

On a transparent polyethylene terephthalate support were coated layers (1) to (12) shown below, in that sequence to prepare light-sensitive sheets (C) and (D).

(1) Same mordant layer as in Example 5

(2) Same white reflection layer as in Example 5

(3) Same light-shielding layer as in Example 5

(4) A layer containing a cyan DRR compound (0.5 g/m$^2$) having the formula shown hereinafter, diethylaurylamide (0.25 g/m$^2$) and gelatin (1.14 g/m$^2$)

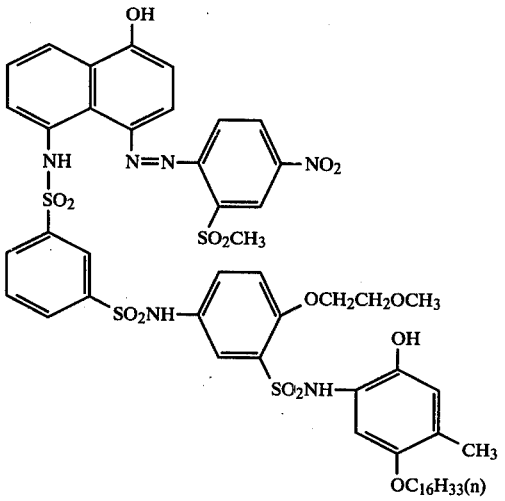

(5) A red-sensitive internal latent image type direct positive silver bromide emulsion layer containing an emulsion as identified below (1.9 g/m$^2$ as silver), a red-sensitive sensitizing dye, the same fogging agent as used in Example 1 (0.07 mg/m$^2$), and sodium 5-pentadecylhydroquinone-2-sulfonate (0.13 mg/m$^2$)

Light-sensitive sheet (C): Emulsion (1) defined in Example 1

Light-sensitive sheet (D): Emulsion (2) defined in Example 1

(6) A layer containing gelatin (2.6 g/m$^2$) and 2,5-dioctylhydroquinone (1.0 g/m$^2$)

(7) Same layer as layer (4) in Example 5 except that it further contained 0.45 g/m$^2$ of the magenta DRR compound shown below:

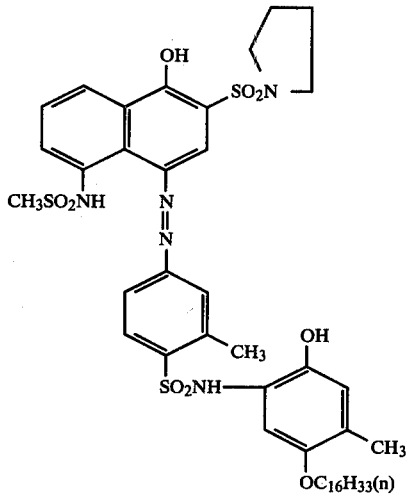

(8) Same green-sensitive internal latent image type direct positive emulsion layer as used in Example 5

Light-sensitive sheet (C): Emulsion (1)

Light-sensitive sheet (D): Emulsion (2)

(9) Same layer as the above described layer (6)

(10) A layer containing a yellow DRR compound having the formula shown below (0.78 g/m$^2$), diethylaurylamide (0.16 g/m$^2$), 2,5-di-tert-butylhydroquinone (0.012 g/m$^2$), and gelatin (0.78 g/m$^2$)

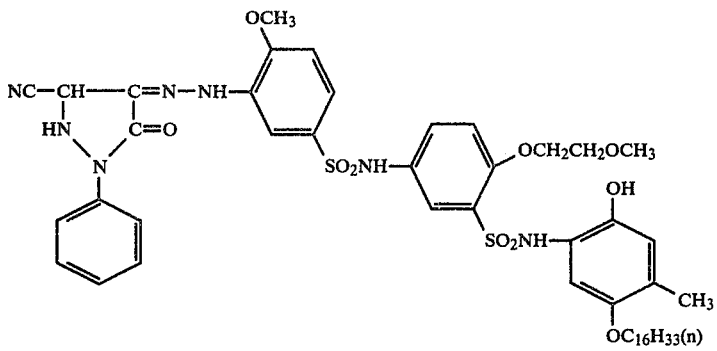

(11) A blue-sensitive internal latent image type direct positive silver bromide emulsion layer containing an emulsion as described below (2.2 g/m$^2$ as silver), a blue-sensitive sensitizing dye, the same fogging agent as was used in Example 1 (0.08 mg/m$^2$) and sodium 5-penthadecylhydroquinone-2-sulfonate (0.094 g/m$^2$)

Light-sensitive sheet (C): Emulsion (1) defined in Example 1

Light-sensitive sheet (D): Emulsion (2) defined in Example 1

(12) A layer containing gelatin (0.94 g/m$^2$)

Processing Liquid

Same processing liquid as was used in Example 5

Cover Sheet

On a polyethylene terephthalate support were coated layers (1) to (3) shown below, in that sequence, to prepare a cover sheet.

(1) In 1,000 g of a 20% solution of an acrylic acid-butyl acrylate (mole ratio=8/2) copolymer having an average molecular weight of 50,000 in a mixed solvent of acetone and water (volume ratio=3/1) was dissolved 3.8 g of 5-(2-cyanoethylthio)-1-phenyltetrazole. The resulting solution was coated in an amount of 110 g per square meter to prepare a coating film having a thickness of about 20 microns.

(2) A mixture of 55 g of cellulose acetate having a degree of oxidation of 52.1% (0.521 g of acetic acid per gram of the cellulose acetate was released by hydrolysis) and 5 g of a styrene-maleic anhydride copolymer (mole ratio=1/1) was dissolved in a mixed solvent of acetone and cyclohexanone (volume ratio=3/1). The resulting solution was coated in an amount of 50 g per square meter to prepare a coating film having a thickness of about 2.6 microns.

(3) A polymer latex (solid content: 10%) which was prepared by emulsion polymerizing a mixture of styrene, butyl acrylate and acrylic acid (weight ratio=52/42/6) was coated in an amount of 30 ml per square meter.

Processing Step

The cover sheet was superposed on the light-sensitive sheet, which was then imagewise exposed through a continuous gradation wedge from the cover sheet side. Thereafter, the processing liquid was extended in a thickness of 80 microns by means of press rolls between the two sheets.

Processing was performed at 25° C. After processing, the photographic characteristics of the color positive image formed in each sheet were examined: the results are shown in Table 6.

TABLE 6

| Light sensitive Sheet | Emulsion | Dmax | Dmin | |
|---|---|---|---|---|
| C | (1) | B* | 1.73 | 0.35 |
| | | G | 1.97 | 0.36 |
| | | R | 2.04 | 0.47 |
| D | (2) | B | 1.82 | 0.33 |
| | | G | 2.13 | 0.33 |
| | | R | 2.31 | 0.42 |

The symbols B, G and R indicate the blue-sensitive layer, green-sensitive layer and red-sensitive layer, respectively.

As is apparent from the results shown in Table 6, for light-sensitive sheet D which was prepared using emulsion (2) prepared in accordance with the process of the invention, Dmax was high and Dmin was low compared with those of light-sensitive sheet C which was prepared using emulsion (1) prepared by a conventional method.

EXAMPLE 7

To emulsion C prepared in Example 3 was added sodium thiosulfate under the same conditions as for the preparation of emulsion (3) in Example 3 to perform surface chemical sensitization, thus preparing emulsion (7). Also, emulsion (8) was prepared in the same manner as for emulsion (7) except that polymer (1) of the invention was added in an amount of 85 mg per mol of silver at the step of surface chemical sensitization, emulsion (9) was prepared in the same manner as for emulsion (7) except that polymer (1) was added in an amount of 340 mg per mol of silver, and emulsion (10) was prepared in the same manner as for emulsion (7) except that polymer (1) was added in an amount of 1.1 g per mol of silver. To each emulsion was added a red-sensitive sensitizing dye in the same amount, and the resulting mixture was coated, exposed and processed in the same manner as in Example 5, whereafter photographic sensitivity [$S^{\frac{1}{2}}$rel] was measured to obtain the results shown in Table 7.

TABLE 7

| Emulsion | Amount of Polymer (1) Added (mg/Ag mol) | $S^{\frac{1}{2}}$rel* |
|---|---|---|
| Emulsion (7) | — | 100 |
| Emulsion (8) | 85 | 150 |
| Emulsion (9) | 340 | 120 |

TABLE 7-continued

| Emulsion | Amount of Polymer (1) Added (mg/Ag mol) | $S^{\frac{1}{2}}rel$* |
|---|---|---|
| Emulsion (10) | 1,100 | 90 |

*The symbol $S^{\frac{1}{2}}rel$ indicates the relative value ofphotographic sensitivity to red light at a densityof (Dmax + Dmin)/2

From the results shown in Table 7 it can be seen that addition of polymers having a repeating unit of general formula (I) in an amount of 1.1 g/mol of Ag or more deteriorated photographic properties when color sensitization was effected.

While the invention has been described in detail and with reference to specific embodiment thereof, it will be apparent to one skilled in the art that various changes and modifications can be made therein without departing from the spirit and scope thereof.

What is claimed is:

1. A process for the preparation of an internal latent image type silver halide emulsion containing silver halide grains comprising a central core of silver halide doped with metal ions, chemically sensitized or a combination thereof and an outer shell of silver halide covering at least light-sensitive sites of the central core, which process is characterized in that the surface of the silver halide grain is subjected to chemical sensitization in the presence of a homopolymer or copolymer to improve said surface chemical sensitization, said homopolymer containing a repeating unit represented by general formula (I) and said copolymer selected from the group consisting of copolymers obtained by copolymerization of only monomer units of the formula (I) and copolymers obtained by the copolymerization of a monomer unit of the formula (I) copolymerized with an addition-polymerizable ethylenically unsaturated compound:

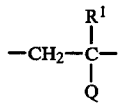

(I)

wherein $R^1$ is a hydrogen atom or an alkyl group, and Q is any one of groups (1) to (4) set forth below:

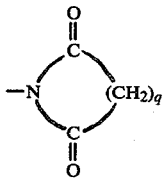

(1)

wherein q is an integer of from 2 to 4,

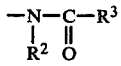

(2)

wherein $R^2$ and $R^3$ are each a hydrogen atom or an alkyl group,

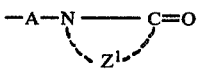

(3)

wherein $Z^1$ is a group of atoms required to a lactam ring, an oxazolidone ring or a pyridone ring, and A is a bond,

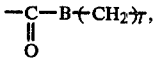

wherein B is

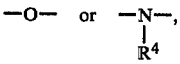

wherein $R^4$ is a hydrogen atom or an alkyl group, and l is an integer of from 1 to 6,

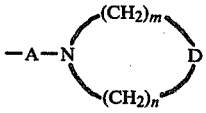

(4)

wherein A is the same as defined for the above formula (3), D is a bond, —O—, or

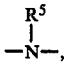

wherein $R^5$ is a hydrogen atom, an alkyl group or

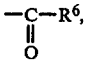

wherein $R^6$ is an alkyl group, and m and n are each an integer of from 1 to 6 and m+n is from 4 to 7;

and wherein said homopolymer is present in an amount of from 0.002 to 1 g per mol of silver or said copolymer is present in an amount providing 0.002 to 1 g of the repeating unit of the formula (I) per mol of silver.

2. The process as recited in claim 1, wherein $R^1$ is a hydrogen atom.

3. The process as recited in claim 2 wherein Q represents a group selected from the group consisting of the following (i)-(iii):

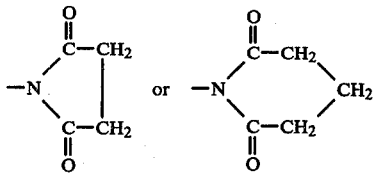

(i)

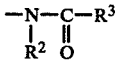

(ii)

wherein $R^2$ represents a methyl group or an ethyl group, and $R^3$ represents a hydrogen atom, a methyl group or an ethyl group

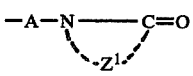

(iii)

wherein A represents a single bond or

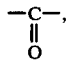

and $Z^1$ forms a 5-membered or 6-membered lactam ring or an oxazolidone ring.

4. The process as recited in claim 3, wherein Q represents

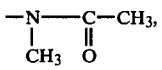

a pyrrolidone group or an oxazolidone group.

5. The process as recited in claim 4, wherein Q represents a pyrrolidone group.

6. The process as recited in claim 1, wherein said chemical sensitization occurs in the presence of said homopolymer.

7. The process as recited in claim 1, wherein said chemical sensitization occurs in the presence of said copolymer.

8. The process recited in claim 1 wherein said homopolymer or copolymer has a molecular weight of about 2000 or more.

9. The process as recited in claim 1, wherein said homopolymer or copolymer is selected from a group consisting of poly-(N-vinylpyrrolidone), poly-(N-vinyloxazolidone), poly-(N-vinylsuccinimide), poly-(N-vinylglutarimide), poly(N-vinylpiperidone), poly-(N-vinyl-ϵ-caprolactam), poly(N-methyl-N-vinylacetamide), poly-(N-ethyl-N-vinylacetamide), poly-(N-vinylacetamide), vinyl alcohol-N-vinyl acetamide copolymer (molar ratio: 30:70), vinly alcohol-N-vinylpyrrolidone copolymer (molar ratio: 20:80), vinyl alcohol-N-vinylpyrrolidone copolymer (molar ratio: 30:70), N-vinylpyrrolidone-vinyl acetate copolymer (molar ratio: 70:30), N-vinylpyrrolidone-2-hydroxyethyl-acrylate copolymer (molar ratio: 70:30), N-vinylpyrrolidone-acrylic acid copolymer (molar ratio: 90:10), N-vinylpyrrolidone-N-vinyl-3,5-dimethyltriazole copolymer (molar ratio: 50:50), N-vinylpiperidone-2-methoxyethyl acrylate copolymer (molar ratio: 70:30), N-vinylpiperidone-methyl vinyl ether copolymer (molar ratio: 90:10), N-vinyloxazolidone-vinyl alcohol copolymer (molar ratio: 65:35), N-vinyloxazolidoneacrylic acid copolymer (molar ratio: 80:20), N-vinylpyrrolidone-N-vinylpiperidone-2-hydroxyethyl acrylate copolymer (molar ratio: 40:30:30), vinyl alcohol-vinyl acetate-N-vinyl-2-pyridone copolymer (molar ratio: 70:25:5), N-vinylpyrrolidone-2-hydroxyethyl acrylate-vinyl acetate copolymer (molar ratio: 70:20:10), N-vinylpyrrolidone vinyl-alcohol vinyl propionate sodium styrenesulfonate copolymer (molar ratio: 40:40:5:15), N-vinylpyrrolidoneacrylamide copolymer (molar ratio: 60:40), N-vinylpyrrolidone-2-acrylamide-2-methylpropane-sulfonic acid copolymer (molar ratio: 75:25), N-vinylpiperidone-acrylamide copolymer (molar ratio: 60:40), N-vinyloxazolidone-N-(2-hydroxyethyl)acrylamide copolymer (molar ratio: 70:30), N-vinylpyrrolidone-N-vinylmorpholine-acrylamide copolymer (molar ratio: 50:20:30), N-vinylsuccinimide-N-vinyl-ϵ-caprolactam-acrylamide copolymer (molar ratio: 40:20:40), N-vinyloxazolidone-acrylamide-acrylic acid copolymer (molar ratio: 60:20:20), N-vinylpyrrolidone-acrylamide-vinyl acetate-acrylic acid copolymer (molar ratio: 60:20:10:10), and N-vinylpyrrolidone-dimethylacrylamide copolymer (molar ratio: 70:30).

10. The process as recited in claim 1 wherein the amount of homopolymer or copolymer added is from 0.002 to 0.5 g calculated as the amount of the repeating unit of the general formula (I) in the homopolymer or copolymer per mol of silver.

11. The process as recited in claim 10 wherein the amount of homopolymer or copolymer added is from 0.002 to 0.2 g calculated as the amount of the repeating unit of the general formula (I) in the homopolymer or copolymer per mol of silver.

* * * * *